US008648762B2

(12) United States Patent
Su et al.

(10) Patent No.: US 8,648,762 B2
(45) Date of Patent: Feb. 11, 2014

(54) LOOP ARRAY ANTENNA SYSTEM AND ELECTRONIC APPARATUS HAVING THE SAME

(75) Inventors: Saou-Wen Su, Taipei (TW); Tzu-Chieh Hung, Taipei (TW)

(73) Assignees: Lite-On Electronics (Guangzhou) Limited, Ghuangzhou (CN); Lite-On Technology Corp., Taipei (TW)

( * ) Notice: Subject to any disclaimer, the term of this patent is extended or adjusted under 35 U.S.C. 154(b) by 346 days.

(21) Appl. No.: 13/083,969

(22) Filed: Apr. 11, 2011

(65) Prior Publication Data

US 2012/0038534 A1 Feb. 16, 2012

(30) Foreign Application Priority Data

Aug. 13, 2010 (CN) ..... 2010 1 0255303

(51) Int. Cl.
*H01Q 9/16* (2006.01)

(52) U.S. Cl.
USPC ..... 343/835; 343/867

(58) Field of Classification Search
USPC ..... 343/835, 867, 732, 742
See application file for complete search history.

(56) References Cited

U.S. PATENT DOCUMENTS

| | | | | |
|---|---|---|---|---|
| 6,825,816 | B2 * | 11/2004 | Aikawa et al. | 343/770 |
| 7,372,407 | B2 * | 5/2008 | Shi | 343/700 MS |
| 7,675,466 | B2 | 3/2010 | Gaucher et al. | |
| 2003/0184479 | A1 * | 10/2003 | Collins | 343/700 MS |

FOREIGN PATENT DOCUMENTS

TW M357719 U 5/2009

* cited by examiner

*Primary Examiner* — Ahshik Kim
(74) *Attorney, Agent, or Firm* — Rosenberg, Klein & Lee

(57) ABSTRACT

An antenna device includes: a substrate; micro-strip and grounding portions that are respectively disposed on opposite first and second surfaces of the substrate, the former including a signal-feed section for feeding of signals and a plurality of first connecting sections electrically connected to the signal-feed section; and a plurality of first loop antennas arranged along a peripheral edge of the grounding portion, each including a first radiator portion disposed on the first surface and electrically connected to a respective one of the first connecting sections, and a second radiator portion disposed on the second surface, electrically interconnecting the first radiator portion and the grounding portion, and cooperating with the first radiator portion to form a loop.

22 Claims, 12 Drawing Sheets

LOOP ARRAY ANTENNA SYSTEM AND ELECTRONIC APPARATUS HAVING THE SAME

CROSS-REFERENCE TO RELATED APPLICATION

This application claims priority of Chinese Application No. 201010255303.X, filed on Aug. 13, 2010.

BACKGROUND OF THE INVENTION

1. Field of the Invention

The present invention relates to an antenna system and an electronic apparatus having the same, more particularly to a loop array antenna system and an electronic apparatus having the same.

2. Description of the Related Art

Modern wireless network devices, such as wireless access points, generally include lightweight, low-profile antennas. Taiwanese Patent No. M357719 and U.S. Pat. No. 7,675,466 disclose conventional printed-type planar array antennas, respectively, which are operable in a 5-GHz frequency band and are suitable for outdoor network establishment.

However, such planar array antennas have structures having resonant lengths of one-half wavelength, and hence occupy larger surface areas. For example, a 2×2 planar array antenna configuration operating in the 5-GHz frequency band occupies a surface area of 50 mm×50 mm. Furthermore, such planar array antennas generally exhibit poor gain and must be disposed on surfaces of system circuit boards.

Therefore, the need for a relatively small, lightweight, low-profile antennas still exists in the market.

SUMMARY OF THE INVENTION

Therefore, an object of the present invention to provide a relatively small, low-profile antenna device that is suitable for use in WLAN frequency bands.

Accordingly, an antenna device of the present invention includes:

a substrate having opposite first and second surfaces;

a signal-feed network including a micro-strip portion disposed on the first surface of the substrate, and a grounding portion disposed on the second surface of the substrate and corresponding in position with the micro-strip portion, the micro-strip portion including a signal-feed section for feeding of signals, and a plurality of first connecting sections that are electrically connected to the signal-feed section; and a plurality of first loop antennas arranged along a first peripheral edge of the grounding portion, each of the first loop antennas including a first radiator portion disposed on the first surface and electrically connected to a respective one of the first connecting sections, and a second radiator portion disposed on the second surface and electrically interconnecting the first radiator portion of the first loop antenna and the grounding portion, the first and second radiator portions of each of the first loop antennas cooperating to form a loop.

Another object of the present invention is to provide a relatively small, low-profile loop array antenna system that exhibits high gain and high radiation directivity, and that is suitable for use in WLAN frequency bands.

Accordingly, a loop array antenna system of the present invention includes:

an antenna device including a substrate having opposite first and second surfaces, a signal-feed network including a micro-strip portion disposed on the first surface of the substrate, and a grounding portion disposed on the second surface of the substrate and corresponding in position with the micro-strip portion, the micro-strip portion including a signal-feed section for feeding of signals, and a plurality of first connecting sections that are electrically connected to the signal-feed section, and a plurality of first loop antennas arranged along a first peripheral edge of the grounding portion, each of the first loop antennas including a first radiator portion disposed on the first surface and electrically connected to a respective one of the first connecting sections, and a second radiator portion disposed on the second surface and electrically interconnecting the first radiator portion of the first loop antenna and the grounding portion, the first and second radiator portions of each of the first loop antennas cooperating to form a loop; and a system module having a grounding plane that is spaced apart from the substrate and faces toward the second surface of the substrate, and that serves as a reflector for reflecting electromagnetic waves from the antenna device.

Yet another object of the present invention is to provide an electronic apparatus with a loop array antenna system.

Accordingly, an electronic apparatus of the present invention includes:

a housing having a base plate and a cover body disposed on the base plate;

a system module disposed on the base plate and having a grounding plane facing away from the base plate; and an antenna device including a substrate disposed at one side of the system module opposite to the base plate, and having opposite first and second surfaces, the second surface of the substrate spaced apart from and facing toward the grounding plane of the system module, a signal-feed network including a micro-strip portion disposed on the first surface of the substrate, and a grounding portion disposed on the second surface of the substrate and corresponding in position with the micro-strip portion, the micro-strip portion including a signal-feed section for feeding of signals, and a plurality of first connecting sections that are electrically connected to the signal-feed section, and a plurality of first loop antennas arranged along a first peripheral edge of the grounding portion, each of the first loop antennas including a first radiator portion disposed on the first surface and electrically connected to a respective one of the first connecting sections, and a second radiator portion disposed on the second surface and electrically interconnecting the first radiator portion of the first loop antenna and the grounding portion, the first and second radiator portions of each of the first loop antennas cooperating to form a loop.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
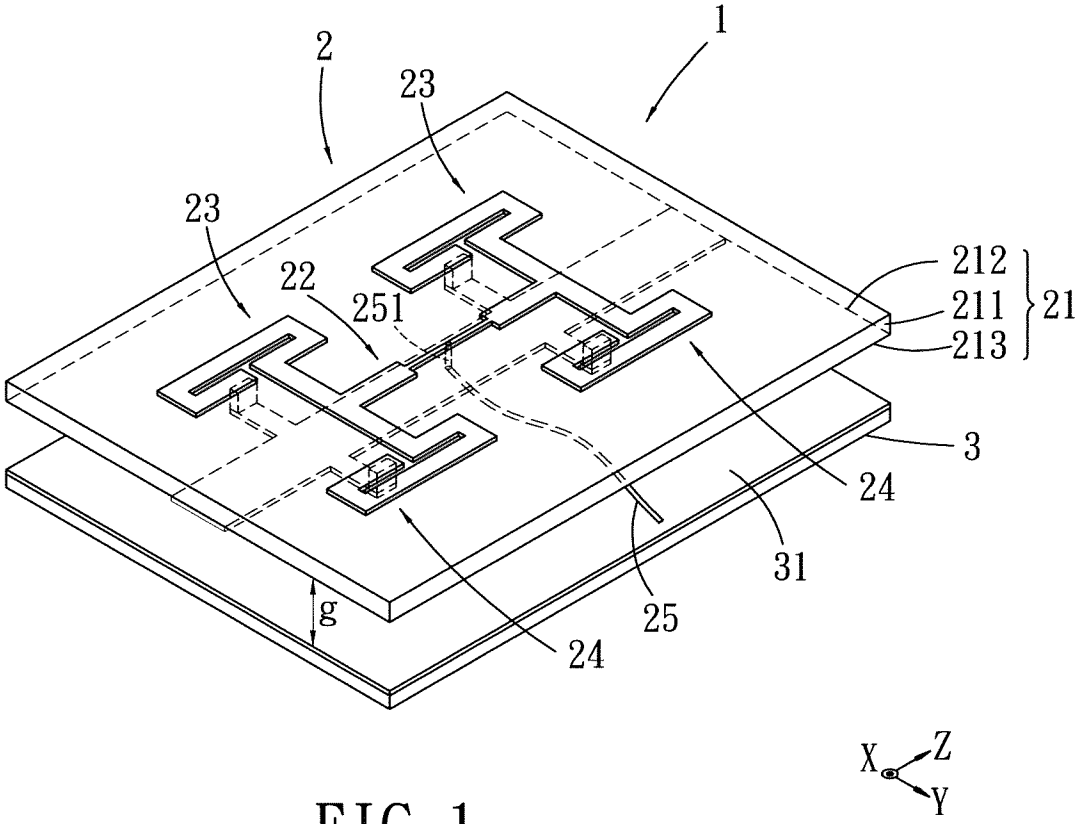
FIG. 1 is a perspective view of the first preferred embodiment of a loop array antenna system according to the present invention.

Before the present invention is described in greater detail, it should be noted that like elements are denoted by the same reference numerals throughout the disclosure.

Referring to FIG. 1, the first preferred embodiment of a loop array antenna system 1 of this invention is installed in an outdoor access point, and includes an antenna device 2 and a system module 3 that is spaced apart from and parallel to the antenna device 2.

The antenna device 2 includes a substrate 21, a signal-feed network 22, a plurality of first loop antennas 23, a plurality of second loop antennas 24, and a signal transmission line 25 (e.g., a coaxial cable). In this embodiment, the first and second loop antennas 23, 24 cooperate to form a 2×2 loop-antenna array configuration. The substrate 21 has a substrate body 211 made of a dielectric material (e.g., glass fiber, FR4), and having opposite first and second surfaces 212, 213. It is to be noted that, in this embodiment, each of the first and second loop antennas 23, 24 is a folded-loop antenna disposed on the substrate 21 using printed circuit board (PCB) techniques. Furthermore, each of the first and second loop antennas 23, 24 is a full-wavelength loop antenna having a balanced structure and characterized by high-gain and directional radiation. In addition, in comparison with conventional planar array antennas, the 2×2 loop—antenna array cooperatively formed by the first and second loop antennas 23, 24, according to the present embodiment, has advantages such as relatively small dimensions and better radiation characteristics.

Figure 2:
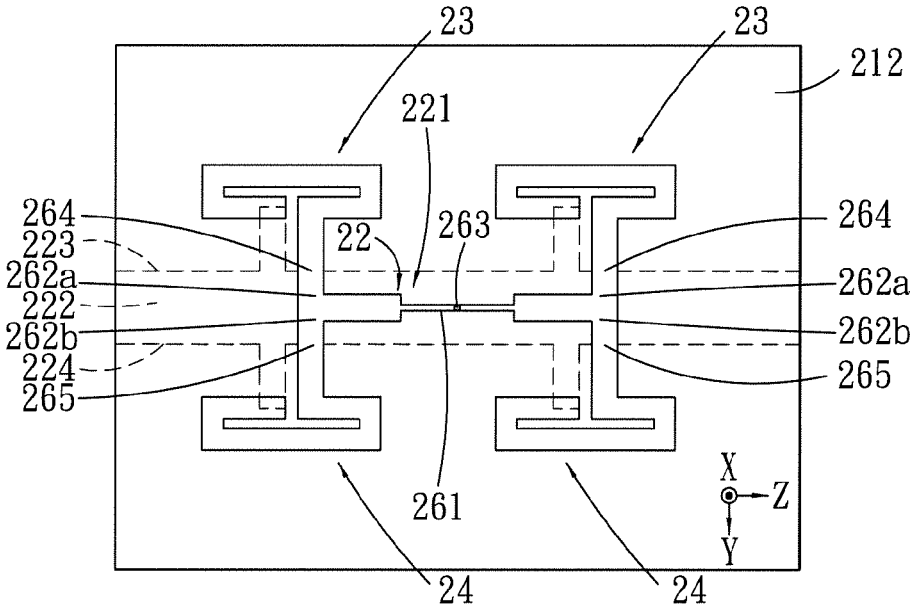
FIG. 2 is a schematic diagram to show a first surface of a substrate of an antenna device of the loop array antenna system.
Figure 3:
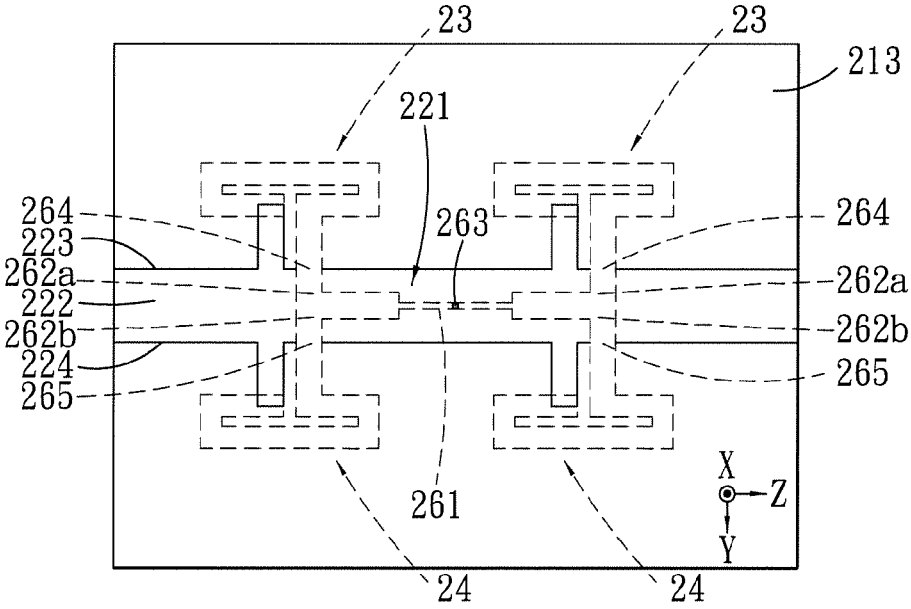
FIG. 3 is a schematic diagram to show a second surface, that is opposite to the first surface, of the substrate of the antenna device of the loop array antenna system.

Referring to FIGS. 2 and 3, the signal-feed network 22 serves to distribute signals, and has a design that may be adjusted for enabling the first and second loop antennas 23, 24 to exhibit predetermined radiation characteristics), and includes a micro-strip portion 221 that is disposed on the first surface 212, and a grounding portion 222 that is disposed on the second surface 213, that corresponds in position with the micro-strip portion 221, and that extends along a z-axis between opposite sides of the substrate body 211.

The micro-strip portion 221 has a signal-feed section 261 having opposite ends, a plurality of first connecting sections 262*a* connected electrically and respectively to the opposite ends of the signal-feed section 261, a plurality of second connecting sections 262*b* connected electrically and respectively to the opposite ends of the signal-feed section 261, and a feed-in section 263 disposed at the center of the signal-feed section 261 for feeding of signals therethrough.

Each of the first connecting sections 262*a* cooperates with a respective one of the second connecting sections 262*b* to form a T-shaped connecting section. Each of the first connecting sections 262*a* has a distal end 264 distal from the signal-feed section 261 and flush with a first peripheral edge 223 of the grounding portion 222. Each of the second connecting sections 262*b* has a distal end 265 distal from the signal-feed section 261 and flush with a second peripheral edge 224 of the grounding portion 222, which, in this embodiment, is disposed parallel and opposite to the first peripheral edge 223.

In the present embodiment, the signal-feed section 261 is relatively narrow in width and has an impedance of 100Ω. Furthermore, each of the T-shaped connecting sections formed by a corresponding pair of the first and second connecting sections 262*a*, 262*b* is relatively wider in width and has an impedance of 50Ω. However, configuration of the micro-strip portion 221 is not limited to such, and may be adjusted according to operating frequencies of the first and second loop antennas 23, 24. The distal end 264 of each of the first connecting sections 262*a* is connected electrically to a corresponding one of the first loop antennas 23. The distal end 265 of each of the second connecting sections 262*b* is connected electrically to a corresponding one of the second loop antennas 24.

Figure 4:
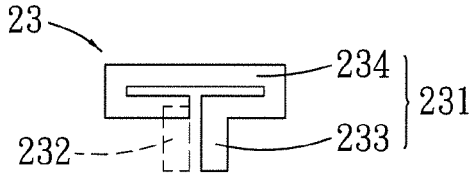
FIG. 4 is a schematic diagram to show a first loop antenna of the antenna device.

Referring to FIGS. 2 and 4, in this embodiment, the first loop antennas 23 are spacedly arranged along the first peripheral edge 223. Each of the first loop antennas 23 includes a first radiator portion 231 disposed on the first surface 212 and electrically connected to the distal end 264 of a respective one of the first connecting sections 262*a*, and a second radiator portion 232 disposed on the second surface 213 and electrically interconnecting the first radiator portion 231 and the grounding portion 222. The first and second radiator portions 231, 232 of each of the first loop antennas 23 are preferably connected electrically to each other via a via hole, and cooperate to form a loop. The first radiator portion 231 of each of the first loop antennas 23 includes: a connecting radiator section 233 electrically connected to the respective one of the first connecting sections 262*a*, and parallel to and spaced apart from a projection of the second radiator portion 232 of the first loop antenna 23 onto the first surface 212; and an intermediate radiator section 234 having the form of a loop, and electrically interconnecting the connecting radiator section 233 of the first radiator portion 231 and the second radiator portion 232 of the first loop antenna 23. In the present embodiment, each of the first loop antennas 23 is a full-wavelength loop antenna preferably configured to operate in a 5-GHz frequency band.

Figure 5:
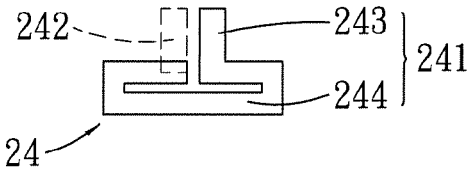
FIG. 5 is a schematic diagram to show a second loop antenna of the antenna device.

Referring to FIGS. 2 and 5, in this embodiment, the second loop antennas 24 are spacedly arranged along the second peripheral edge 224, and are symmetric to the first loop antennas 23, respectively, with respect to the grounding portion 222. Each of the second loop antennas 24 includes a third radiator portion 241 disposed on the first surface 212 and electrically connected to the distal end 265 of a respective one of the second connecting sections 262*b*, and a fourth radiator portion 242 disposed on the second surface 213 and electrically interconnecting the third radiator portion 241 and the grounding portion 222. The third and fourth radiator portions 241, 242 of each of the second loop antennas 24 are connected electrically to each other via such as a via hole, and cooperate with each other to form a loop. The third radiator portion 241 of each of the second loop antennas 24 includes: a connecting radiator section 243 electrically connected to the respective one of the second connecting sections 262*b*, and parallel to and spaced apart from a projection of the fourth radiator portion 242 of the second loop antenna 24 onto the first surface 212; and an intermediate radiator section 244 having the form of a loop, and electrically interconnecting the connecting radiator section 243 of the third radiator portion 241 and the fourth radiator portion 242 of the second loop antenna 24. In the present embodiment, each of the second loop antennas 24 is a full-wavelength loop antenna preferably configured to operate in a 5-GHz frequency band.

Referring again to FIG. 1, the signal transmission line 25 includes a signal-feed end 251 that extends through the substrate body 211 from the second surface 213 to the first surface 212 and that is electrically connected to the feed-in section 263 of the micro-strip portion 221 for feeding of signals therethrough.

Figure 6:
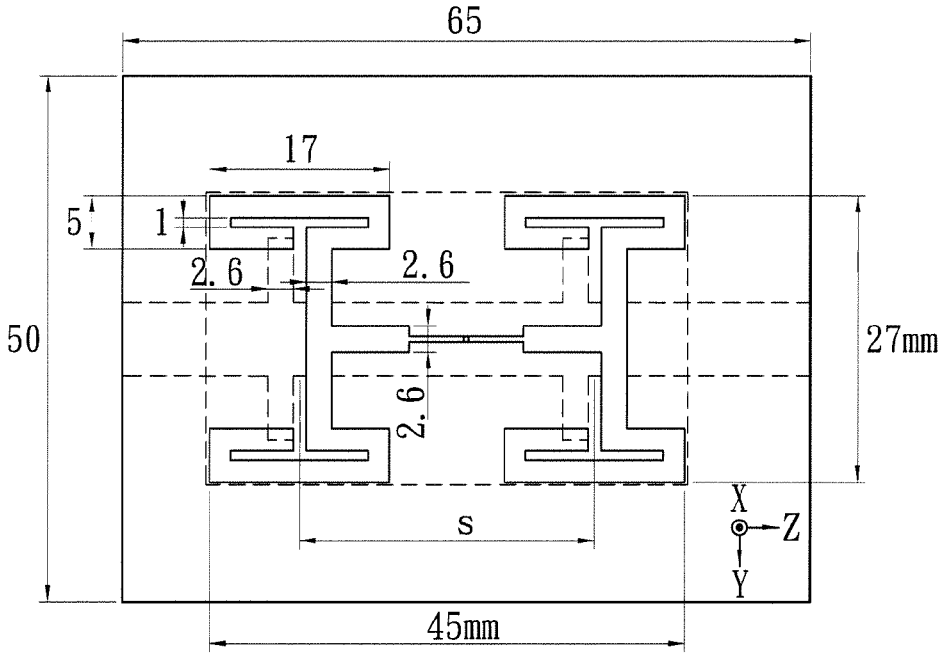
FIG. 6 is a schematic diagram to illustrate dimensions of elements disposed on the first surface of the substrate.

Referring to FIG. 6, in this embodiment, the 2×2 loop-antenna array configuration of the first and second loop antennas 23, 24 has dimensions of 27 mm×45 mm, which are relatively small in comparison with a conventional 2×2 planar array antenna operable in the same frequency band. It is to be noted that centers bounded by the first loop antennas 23 are spaced apart from each other by a predetermined distance (s), that those bounded by the second loop antennas 24 are spaced apart from each other by the predetermined distance (s), and that the predetermined distance (s) preferably ranges between 0.52λ and 1λ, where λ is the wavelength at which the first and second loop antennas 23, 24 operate, such that the first and second loop antennas 23, 24 have optimal antenna gains.

In this embodiment, the signal-feed network 22 is configured to feed signals to the first and second loop antennas 23, 24 such that signals radiated thereby are substantially identical in amplitude and phase, thereby achieving efficient radiation of signals. In addition, the antenna device 2 of this embodiment is implemented by means of printed circuit board processes, and hence has relatively low costs and small dimensions.

Referring again to FIG. 1, the system module 3 has a grounding plane 31 (e.g. a metal plane) that is spaced apart from the substrate body 211 and faces toward the second surface 213, and that serves as a reflector for reflecting electromagnetic waves from the antenna device 2 such that signals radiated by the antenna device 2 has a relatively high directivity. In this embodiment, the signals radiated by the antenna device 2 are directed along a positive X-axis. Specifically, the grounding plane 31 is spaced apart from the second surface 213 by a predetermined spacing (g) of preferably 5.4 mm, such that the antenna device 2 may achieve an optimal overall antenna gain and that electronic components may be disposed on the grounding plane 31, thereby enabling the loop array antenna system 1 to occupy less space and to have a relatively low profile.

It is to be noted that, in comparison with conventional planar array antennas, the antenna device 2 of the present embodiment is operable without requiring connection to the grounding plane 31, which, in the present embodiment, merely serves to reflect signals from the antenna device 2 such that signals radiated by the antenna device 2 are directional instead of bi-directional. Such a configuration of the grounding plane 31 increases the overall antenna gain of the antenna device 2 by 2.5 dB.

Figure 7:
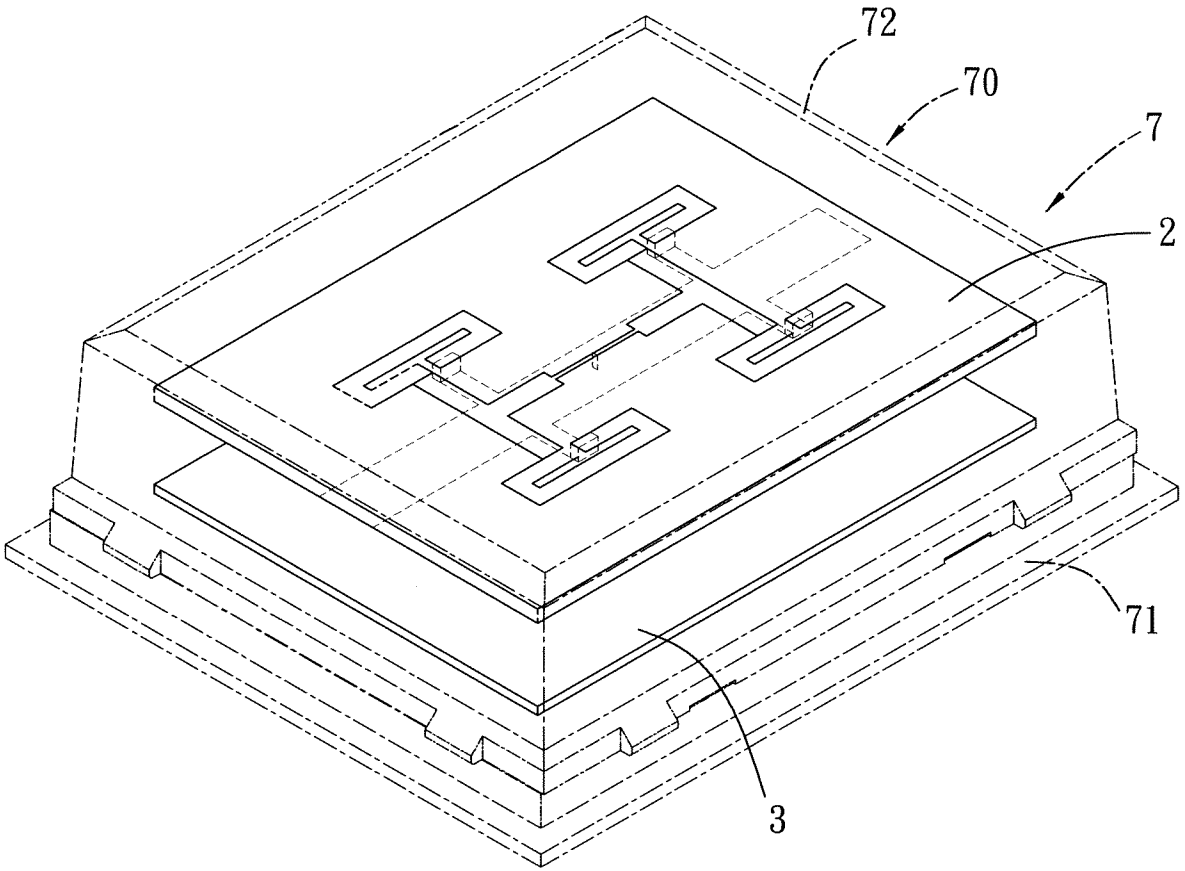
FIG. 7 is a perspective view of an electronic apparatus including a housing and the loop array antenna system disposed in the housing.

Furthermore, the substrate body 211 occupies an area not larger than that occupied by the system module 3, thereby ensuring that the grounding plane 31 is able to completely reflect signals radiated by the antenna device 2. Referring to FIG. 7, the loop array antenna system 1 of the present embodiment may be disposed in a housing 70 of such as a wireless communication device 7. The housing 70 includes a base plate 71 onto which the system module 3 is disposed, and a cover body 72 disposed on the base plate 71. The substrate 21 of the antenna device 2 is disposed on one side of the system module 3 opposite to the base plate 71.

Figure 8:
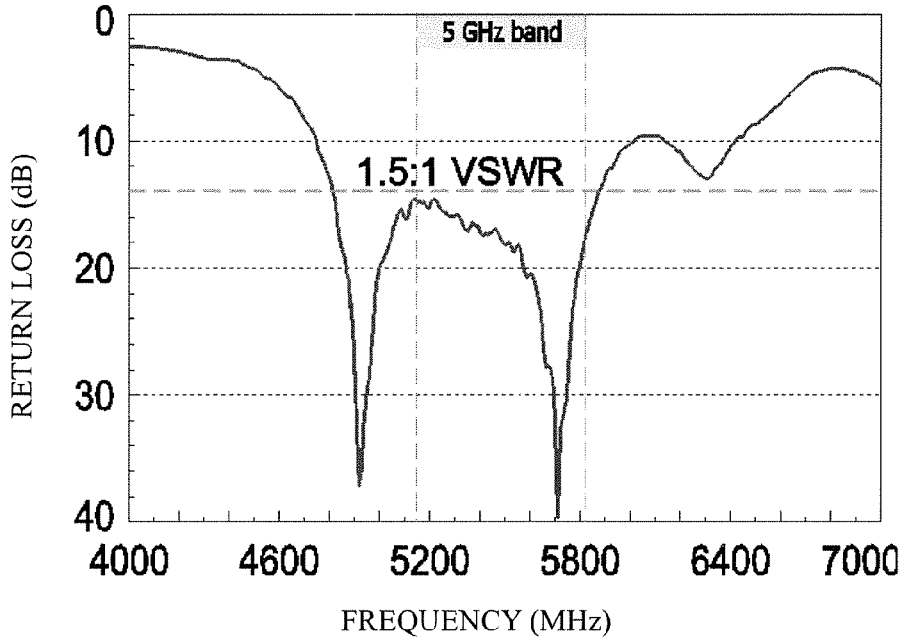
FIG. 8 is a plot of voltage standing wave ratio values of the loop array antenna system at frequencies ranging from 4000 MHz to 7000 MHz.

Referring to FIG. 8, the loop array antenna system 1 of the present embodiment has values of return loss better than 14 dB and values of voltage standing wave ratio lower than 1.5 at frequencies ranging from 4870 MHz to 5860 MHz. Moreover, at 990 MHz, the loop array antenna system 1 has a VSWR value of 1.5:1 (i.e., a return loss of 14 dB), which satisfies the bandwidth specification of the 5 GHz frequency band.

Figure 9:
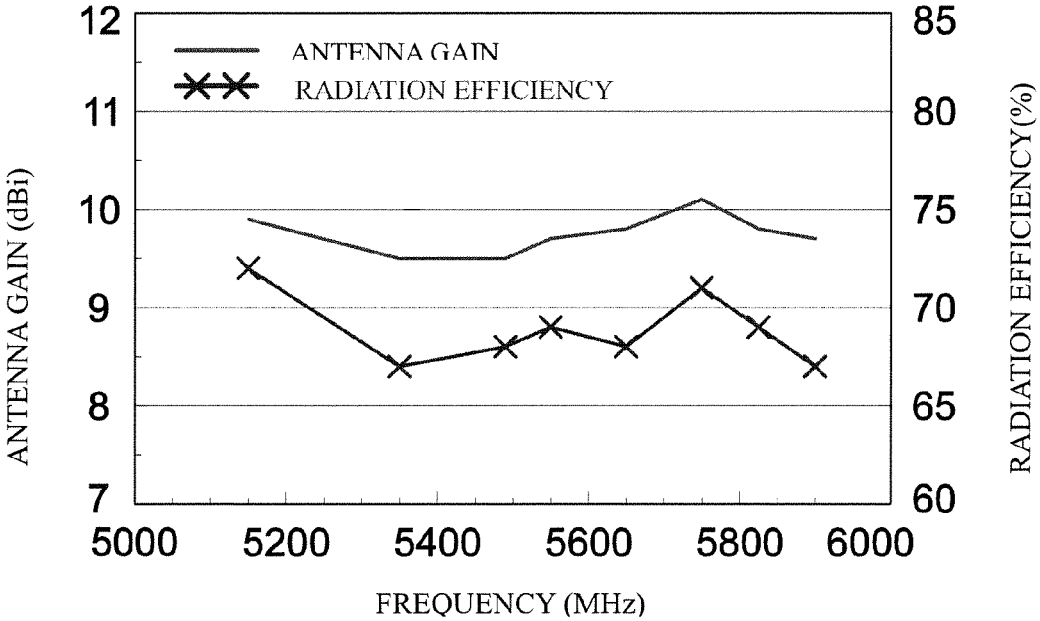
FIG. 9 is a plot of antenna gain and radiation efficiency of the loop array antenna system at frequencies ranging from 5000 MHz to 6000 MHz.

Referring to FIG. 9, the loop array antenna system 1 has values of overall antenna gain higher than 9.5 dBi and values of radiation efficiency higher than 65% in the 5-GHz frequency band. Therefore, the loop array antenna system 1 is applicable to an outdoor wireless access point.

Figure 10:
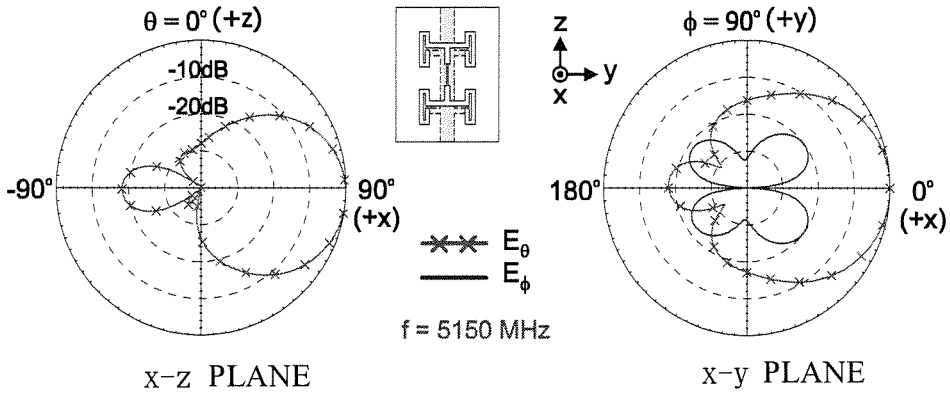
FIG. 10 shows two-dimensional radiation patterns of the loop array antenna system when the loop array antenna system is operated at a frequency of 5150 MHz.
Figure 11:
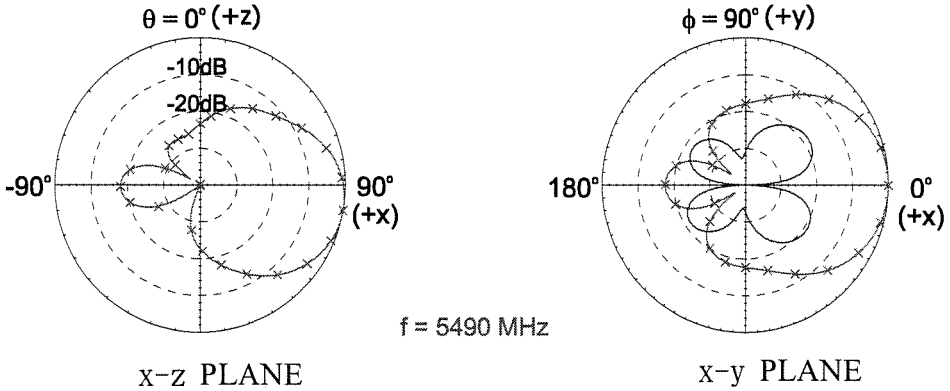
FIG. 11 shows two-dimensional radiation patterns of the loop array antenna system when the loop array antenna system is operated at a frequency of 5490 MHz.
Figure 12:
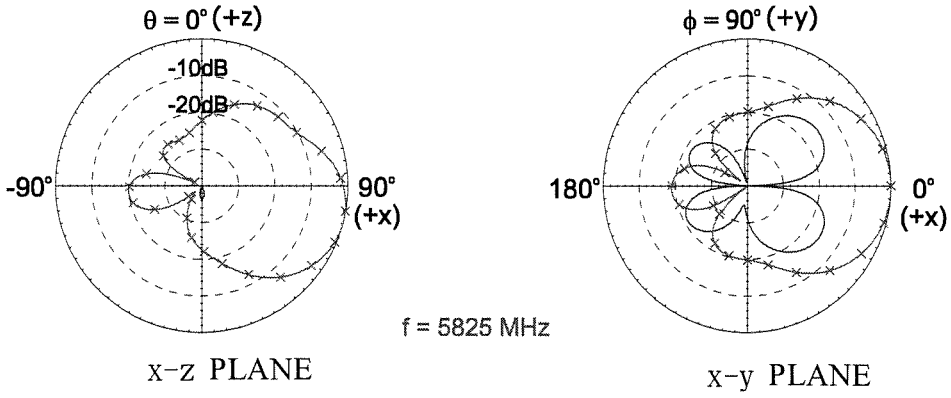
FIG. 12 shows two-dimensional radiation patterns of the loop array antenna system when the loop array antenna system is operated at a frequency of 5825 MHz.

FIGS. 10, 11, and 12 show two-dimensional radiation patterns of the loop array antenna system 1 at frequencies of 5150 MHz, 5490 MHz, and 5825 MHz, respectively.

Figure 13:
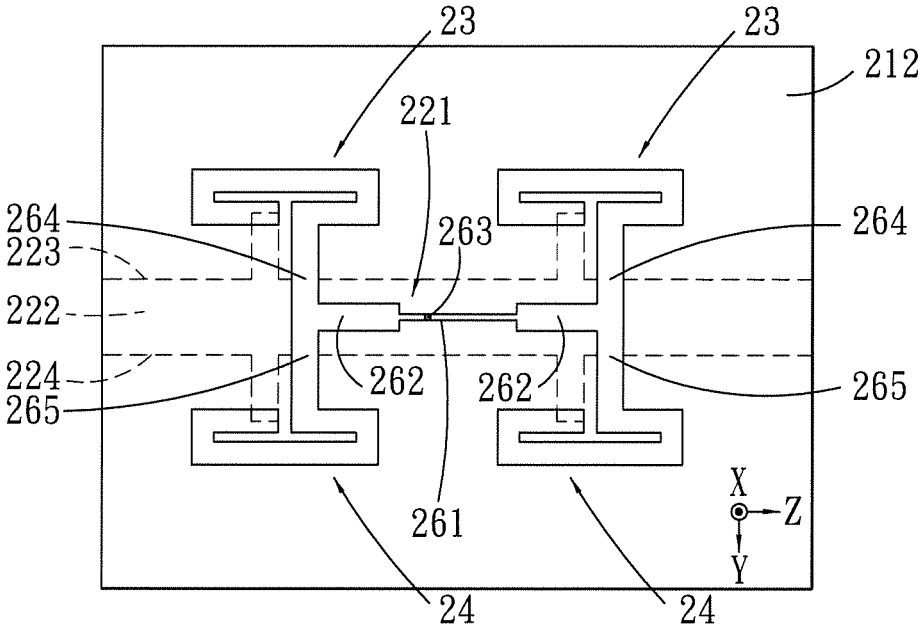
FIG. 13 is a schematic diagram to show a modification of the loop array antenna system of the first preferred embodiment according to the present invention.

Referring to FIG. 13, in a modification of the first preferred embodiment, the feed-in section 263 is disposed toward one of the opposite ends of the signal-feed section 261 instead of being disposed at the center of the same. Such a configuration changes slightly the direction into which the loop array antenna system 1 radiates signals without significantly affecting the overall antenna gain and radiation efficiency of the loop array antenna system 1, which is useful for adapting to different environments.

Figure 14:
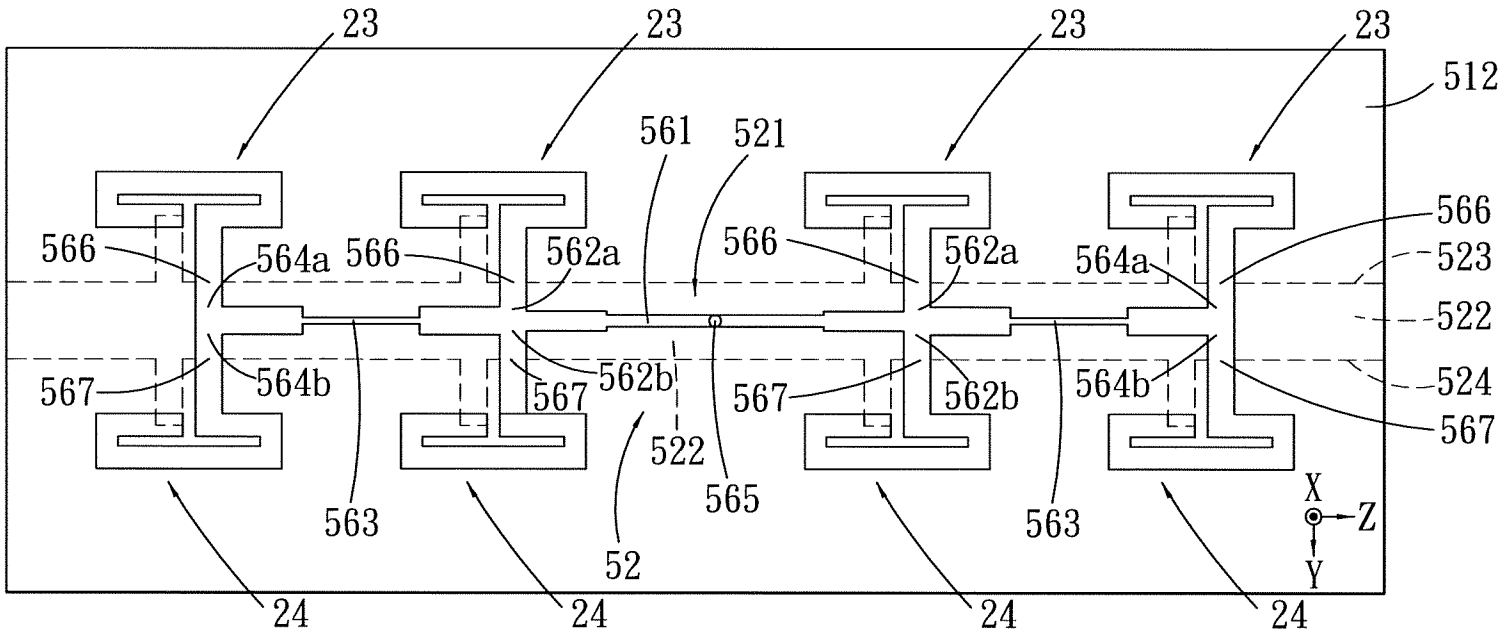
FIG. 14 is a schematic diagram to show an antenna device of the second preferred embodiment of a loop array antenna system according to the present invention.
Figure 15:
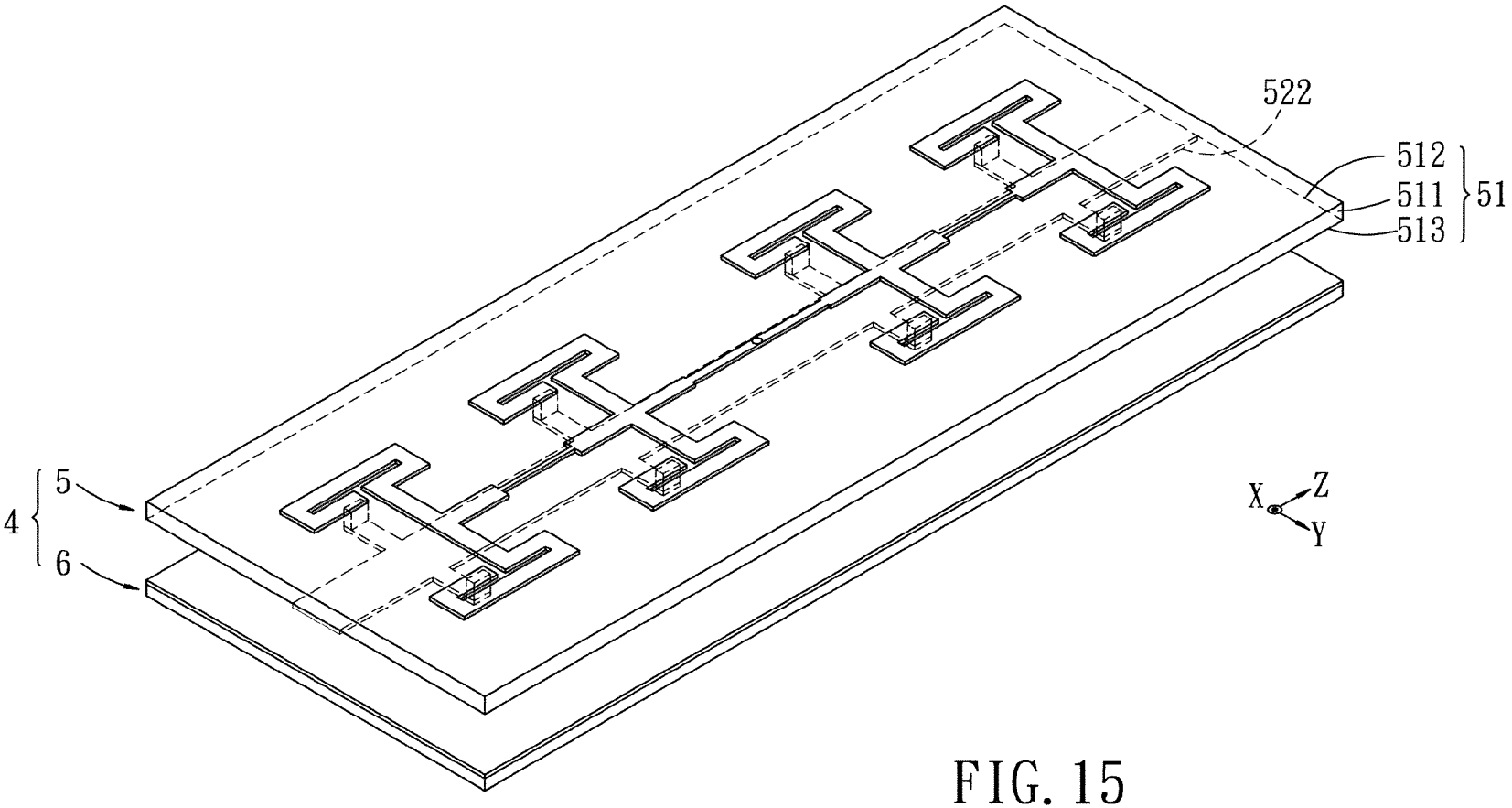
FIG. 15 is a perspective view of the loop array antenna system of the second preferred embodiment.

Referring to FIGS. 14 and 15, the second preferred embodiment of a loop array antenna system 4 of this invention is similar to the first preferred embodiment, and includes an antenna device 5 and a system module 6 that is spaced apart from and parallel to the antenna device 5. The system module 6 of this embodiment is identical in terms of structure and functions compared to that in the first preferred embodiment, and will not be described further for the sake of brevity. Moreover, the main difference between the first and second preferred embodiments resides in that the first and second loop antennas 23, 24 of the latter are greater in number relative to those of the former.

The antenna device 5 of the second preferred embodiment includes a substrate 51, a signal-feed network 52, a plurality of first loop antennas 23, a plurality of second loop antennas 24, and a signal transmission line 25. In this embodiment, configurations of the first and second loop antennas 23, 24 with respect to the signal-feed network 52 are substantially identical to those of the first and second loop antennas 23, 24 with respect to the signal-feed network 22 in the first preferred embodiment. The substrate 51 has a substrate body 511, and opposite first and second surfaces 512, 513.

The signal-feed network 52 of the antenna device 5 includes a micro-strip portion 521 that is disposed on the first surface 512, and a grounding portion 522 that is disposed on the second surface 513, that corresponds in position with the micro-strip portion 521, and that extends between opposite sides of the substrate body 511.

The micro-strip portion 521 has: a first signal-feed section 561 having opposite ends; a plurality of first connecting sections 562*a* connected electrically and respectively to the opposite ends of the first signal-feed section 561; a plurality of second connecting sections 562*b* connected electrically and respectively to the opposite ends of the first signal-feed section 561; a plurality of second signal-feed sections 563 each of which is in alignment with the first signal-feed section 561, is connected electrically to a junction of a respective pair of the first and second connecting sections 562*a*, 562*b*, and has a distal end distal from the respective pair of the first and second connecting sections 562*a*, 562*b*; a plurality of third connecting sections 564*a* each of which is connected electrically to the distal end of a respective one of the second signal-feed sections 563; a plurality of fourth connecting sections 564*b* each of which is connected electrically to the distal end of a respective one of the second signal-feed sections 563; and a feed-in section 565 disposed at the center of the signal-feed section 561 for feeding of signals therethrough. Each of the first and third connecting sections 562*a*, 564*a* has a distal end 566 that is distal from a central line extending along the first signal-feed section 561 and that is flush with a first peripheral edge 523 of the grounding portion 522. Each of the second and fourth connecting sections 562*b*, 564*b* has a distal end 567 that is distal from the central line extending along the first signal-feed section 561 and that is flush with a second peripheral edge 524 of the grounding portion 522. Identical to the first preferred embodiment, the second peripheral edge 524 is disposed opposite to the first peripheral edge 523. Each of the distal ends 566 of the first and third connecting sections 562*a*, 564*a* is connected electrically to a respective one of the first loop antennas 23, and each of the distal ends 567 of the second and fourth connecting sections 562*b*, 564*b* is connected electrically to a respective one of the second loop antennas 24. Moreover, the first loop antennas 23 are symmetric to the second loop antennas with respect to the central line extending along the first signal-feed section 561.

Of course, the first and second loop antennas 23, 24 may be increased in number to thereby improve radiation performance.

Figure 16:
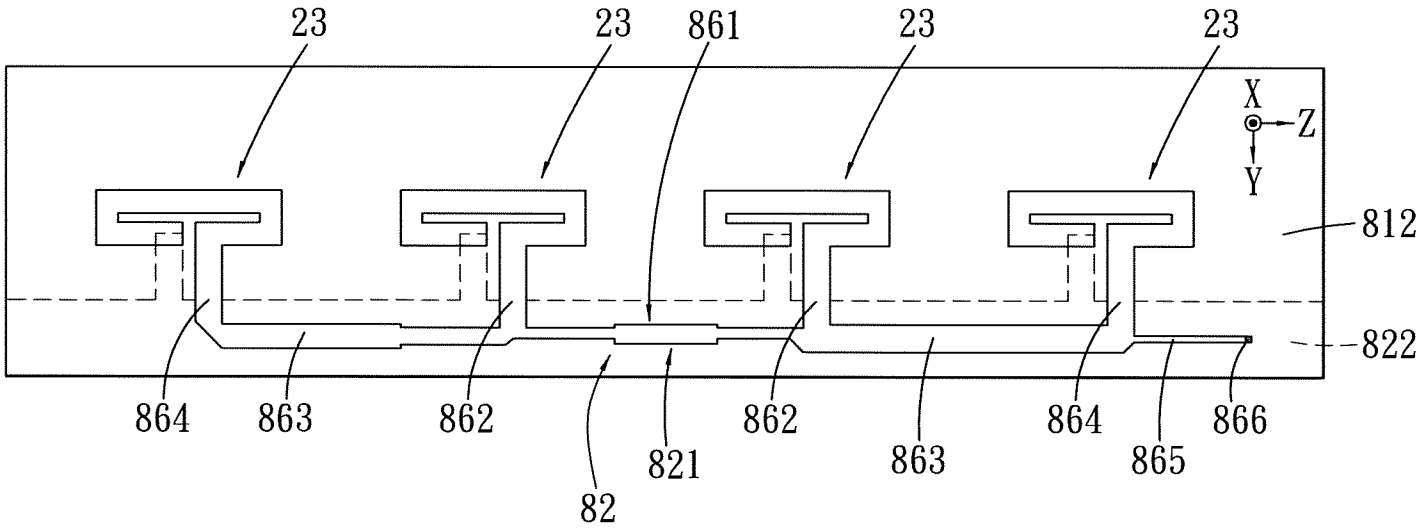
FIG. 16 is a schematic diagram to show an antenna device of the third preferred embodiment of a loop array antenna system according to the present invention.
Figure 17:
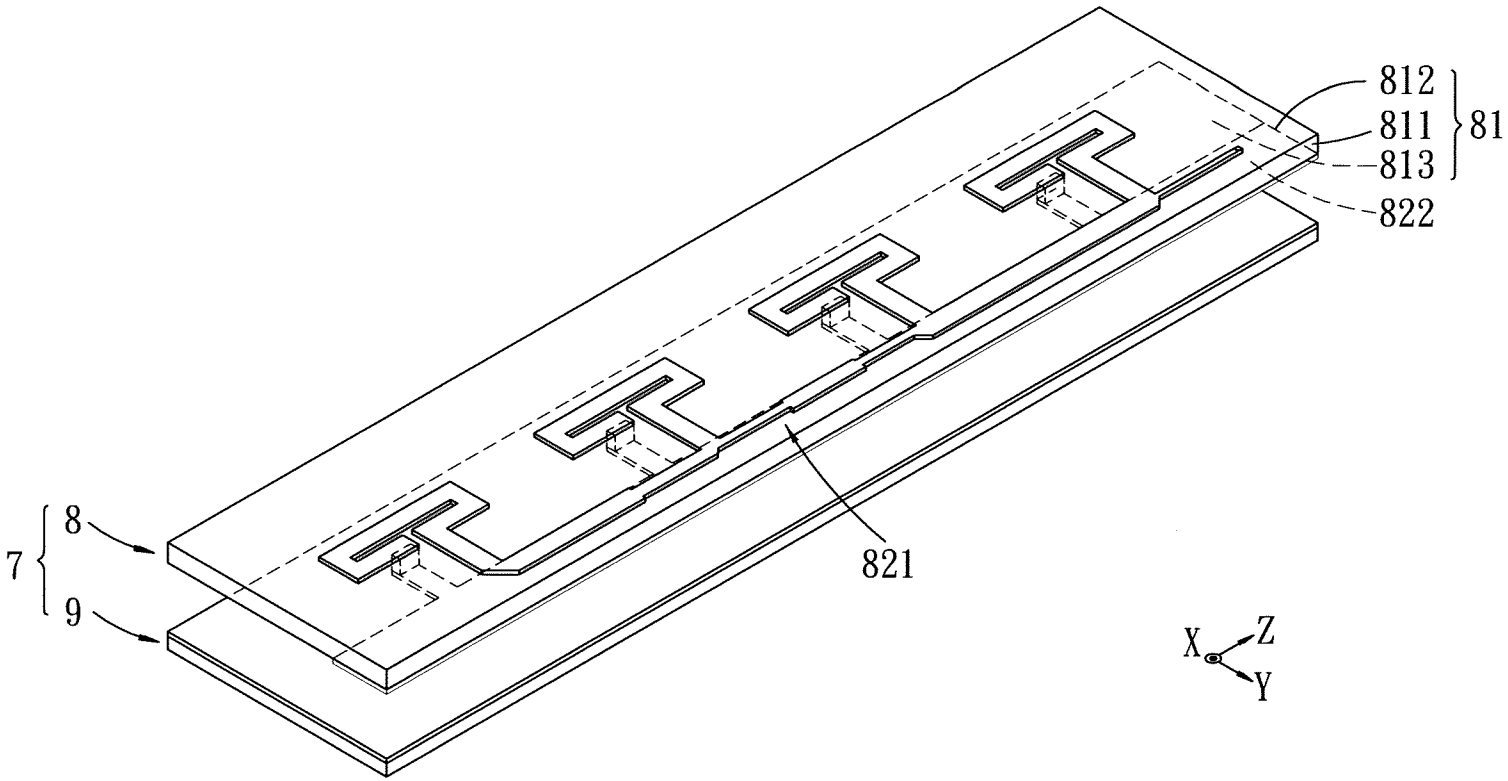
FIG. 17 is a perspective view of the loop array antenna system of the third preferred embodiment.

Referring to FIGS. 16 and 17, the third preferred embodiment of a loop array antenna system 7 of this invention includes an antenna device 8 and a system module 9 spaced apart from and parallel to the antenna device 8. The system module 9 of this embodiment is identical in terms of structure and functions compared to that in the second preferred embodiment, and will not be described further for the sake of brevity. Moreover, the main difference between the second and third preferred embodiments resides in that the antenna device 8 of the third preferred embodiment does not include any second loop antenna.

The antenna device 8 of the third preferred embodiment includes a substrate 81, a signal-feed network 82, a plurality of first loop antennas 23, and a signal transmission line (not shown in FIGS. 16 and 17). In this embodiment, configuration of the first loop antennas 23 with respect to the signal-feed network 82 is substantially identical to that of the first loop antennas 23 with respect to the signal-feed network 22 in the first preferred embodiment. The substrate 81 has a substrate body 811, and opposite first and second surfaces 812, 813.

The signal-feed network 82 of the antenna device 8 includes a micro-strip portion 821 that is disposed on the first surface 812, and a grounding portion 822 that is disposed on the second surface 813, that corresponds in position with the micro-strip portion 821, and that extends between opposite sides of the substrate body 811.

The micro-strip portion 821 has: a first signal-feed section 861 having opposite ends; a plurality of first connecting sections 862 connected electrically and respectively to the opposite ends of the first signal-feed section 861; a plurality of second signal-feed sections 863 each of which is in alignment with the first signal-feed section 861, is connected electrically to a respective one of the opposite ends of the first signal-feed section 861, and has a distal end distal from the first signal-feed section 861; a plurality of second connecting sections 864 each of which is connected electrically to the distal end of a respective one of the second signal-feed sections 863; an input signal-feed section 865 connected to the distal end of one of the second signal-feed sections 863, and having a distal end distal therefrom; and a feed-in section 866 disposed at the distal end of the input signal-feed section 865 for feeding of signals therethrough. Each of the first and second connecting sections 862, 864 is connected electrically to a respective one of the first loop antennas 23.

In summary, the antenna devices 2, 5, 8 have relatively small dimensions, and high-directivity and high-gain radiation patterns when used with the system modules 3, 6, 9 such that the antenna devices 2, 5, 8 are suitable for outdoor applications.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna device comprising:

a substrate having opposite first and second surfaces;

a signal-feed network including a micro-strip portion disposed on said first surface of said substrate, and a grounding portion disposed on said second surface of said substrate and corresponding in position with said micro-strip portion, said micro-strip portion including a signal-feed section for feeding of signals, and a plurality of first connecting sections that are electrically connected to said signal-feed section; and a plurality of first loop antennas arranged along a first peripheral edge of said grounding portion, each of said first loop antennas including a first radiator portion disposed on said first surface and electrically connected to a respective one of said first connecting sections, and a second radiator portion disposed on said second surface and electrically interconnecting said first radiator portion of said first loop antenna and said grounding portion, said first and second radiator portions of each of said first loop antennas cooperating to form a loop.

2. The antenna device as claimed in claim 1, wherein each of said first connecting sections of said micro-strip portion has a distal end distal from said signal-feed section and flush with said first peripheral edge of said grounding portion, said first radiator portion of each of said first loop antennas being connected electrically to said distal end of the respective one of said first connecting sections.

3. The antenna device as claimed in claim 1, wherein said first radiator portion of each of said first loop antennas includes a connecting radiator section electrically connected to the respective one of said first connecting sections, and parallel to and spaced apart from a projection of said second radiator portion of said first loop antenna onto said first surface of said substrate, and an intermediate radiator section having the form of a loop, and electrically interconnecting said connecting radiator section of said first radiator portion and said second radiator portion of said first loop antenna.

4. The antenna device as claimed in claim 3, wherein said intermediate radiator section and second radiator portion of each of said first loop antennas are connected electrically to each other via a via hole that extends through said first and second surfaces of said substrate.

5. The antenna device as claimed in claim 1, wherein:

said micro-strip portion of said signal-feed network further includes a plurality of second connecting sections that are electrically connected to said signal-feed section; and said antenna device further includes a plurality of second loop antennas arranged along a second peripheral edge of said grounding portion, each of said second loop antennas including a third radiator portion disposed on said first surface and electrically connected to a respective one of said second connecting sections, and a fourth radiator portion disposed on said second surface and electrically interconnecting said third radiator portion of said second loop antenna and said grounding portion, said third and fourth radiator portions of each of said second loop antennas cooperating to forma loop.

6. The antenna device as claimed in claim 5, wherein said first and second peripheral edges of said grounding portion are parallel to each other and are disposed opposite to each other.

7. The antenna device as claimed in claim 6, wherein said grounding portion extends between opposite sides of said substrate.

8. The antenna device as claimed in claim 5, wherein each of said second connecting sections of said micro-strip portion has a distal end distal from said signal-feed section and flush with said second peripheral edge of said grounding portion, said third radiator portion of each of said second loop antennas being connected electrically to said distal end of the respective one of said second connecting sections.

9. The antenna device as claimed in claim 5, wherein said third radiator portion of each of said second loop antennas includes a connecting radiator section electrically connected to the respective one of said second connecting sections, and parallel to and spaced apart from a projection of said fourth radiator portion of said second loop antenna on said first surface of said substrate, and an intermediate radiator section having the form of a loop, and electrically interconnecting said connecting radiator section of said third radiator portion and said fourth radiator portion of said second loop antenna.

10. The antenna device as claimed in claim 9, wherein said intermediate radiator section and fourth radiator portion of each of said second loop antenna are connected electrically to each other via a via hole that extends through said first and second surfaces of said substrate.

11. The antenna device as claimed in claim 5, wherein each of said first and second loop antennas is configured to operate in a 5 GHz frequency band.

12. The antenna device as claimed in claim 5, wherein each of said first connecting sections cooperates with a respective one of said second connecting sections to form a T-shaped connecting section.

13. The antenna device as claimed in claim 1, further comprising a signal transmission line including a signal-feed end that extends through said substrate from said second surface thereof and that is electrically connected to said signal-feed section of said micro-strip portion for feeding of signals.

14. A loop array antenna system comprising:

an antenna device including a substrate having opposite first and second surfaces, a signal-feed network including a micro-strip portion disposed on said first surface of said substrate, and a grounding portion disposed on said second surface of said substrate and corresponding in position with said micro-strip portion, said micro-strip portion including a signal-feed section for feeding of signals, and a plurality of first connecting sections that are electrically connected to said signal-feed section, and a plurality of first loop antennas arranged along a first peripheral edge of said grounding portion, each of said first loop antennas including a first radiator portion disposed on said first surface and electrically connected to a respective one of said first connecting sections, and a second radiator portion disposed on said second surface and electrically interconnecting said first radiator portion of said first loop antenna and said grounding portion, said first and second radiator portions of each of said first loop antennas cooperating to form a loop; and a system module having a grounding plane that is spaced apart from said substrate and faces toward said second surface of said substrate, and that serves as a reflector for reflecting electromagnetic waves from said antenna device.

15. The loop array antenna system as claimed in claim 14, wherein said substrate occupies an area not larger than that occupied by said system module.

16. The loop array antenna system as claimed in claim 14, further comprising a signal transmission line including a signal-feed end that extends through said substrate from said second surface thereof and that is electrically connected to said signal-feed section of said micro-strip portion for feeding of signals.

17. The loop array antenna system as claimed in claim 14, wherein:

said micro-strip portion of said signal-feed network further includes a plurality of second connecting sections that are electrically connected to said signal-feed section; and said antenna device further includes a plurality of second loop antennas arranged along a second peripheral edge of said grounding portion, each of said second loop antennas including a third radiator portion disposed on said first surface and electrically connected to a respective one of said second connecting sections, and a fourth radiator portion disposed on said second surface and electrically interconnecting said third radiator portion of said second loop antenna and said grounding portion, said third and fourth radiator portions of each of said second loop antennas cooperating to form a loop.

18. An electronic apparatus comprising:

a housing having a base plate and a cover body disposed on said base plate;

a system module disposed on said base plate and having a grounding plane facing away from said base plate; and an antenna device including a substrate disposed at one side of said system module opposite to said base plate, and having opposite first and second surfaces, said second surface of said substrate spaced apart from and facing toward said grounding plane of said system module, a signal-feed network including a micro-strip portion disposed on said first surface of said substrate, and a grounding portion disposed on said second surface of said substrate and corresponding in position with said micro-strip portion, said micro-strip portion including a signal-feed section for feeding of signals, and a plurality of first connecting sections that are electrically connected to said signal-feed section, and a plurality of first loop antennas arranged along a first peripheral edge of said grounding portion, each of said first loop antennas including a first radiator portion disposed on said first surface and electrically connected to a respective one of said first connecting sections, and a second radiator portion disposed on said second surface and electrically interconnecting said first radiator portion of said first loop antenna and said grounding portion, said first and second radiator portions of each of said first loop antennas cooperating to form a loop.

19. The electronic apparatus as claimed in claim 18, wherein:

said micro-strip portion of said signal-feed network further includes a plurality of second connecting sections that are electrically connected to said signal-feed section; and said antenna device further includes a plurality of second loop antennas arranged along a second peripheral edge of said grounding portion, each of said second loop antennas including a third radiator portion disposed on said first surface and electrically connected to a respective one of said second connecting sections, and a fourth radiator portion disposed on said second surface and electrically interconnecting said third radiator portion of said second loop antenna and said grounding portion, said third and fourth radiator portions of each of said second loop antennas cooperating to form a loop.

20. The electronic apparatus as claimed in claim 18, wherein said grounding plane serves as a reflector for reflecting electromagnetic waves from said antenna device.

21. The electronic apparatus as claimed in claim 18, wherein said electronic apparatus is an access point.

22. The electronic apparatus as claimed in claim 18, further comprising electronic components disposed on said grounding plane.

* * * * *